US005115528A

United States Patent [19]

Lamle

[11] Patent Number: 5,115,528

[45] Date of Patent: May 26, 1992

[54] PILLOW TRANSFORMABLE INTO ANIMAL CHARACTER

[76] Inventor: Stuart Lamle, 3 Fordham Hill Oval, Ste. 15F, New York City, N.Y. 10468

[21] Appl. No.: 708,469

[22] Filed: May 31, 1991

[51] Int. Cl.[5] ..... A47G 9/00

[52] U.S. Cl. ..... 5/640; 5/636; 446/321

[58] Field of Search ..... 5/434, 436, 437; 446/71, 72, 73, 321, 337, 369; D6/601, 598

[56] References Cited

U.S. PATENT DOCUMENTS 4,404,689 9/1983 DeWan ..... 2/247
4,413,442 11/1983 McSweeney ..... 446/73
4,563,159 1/1986 Hills et al. ..... 446/369
4,614,505 9/1986 Schneider ..... 446/369
4,695,264 9/1987 McLeod, Jr ..... 446/369
4,781,648 11/1988 Garfinkel ..... 446/369
4,842,565 6/1989 Von Philp, Sr. ..... 446/369

*Primary Examiner*—Alexander Grosz
*Attorney, Agent, or Firm*—Robert W. J. Usher

[57] ABSTRACT

A transformable pillow is of bag-form having inner and outer faces separated by padding and, respectively, forming smooth, head supporting and animal shape defining surfaces. Turning the pillow inside out transforms the pillow into an animal character and vice versa.

9 Claims, 3 Drawing Sheets

PILLOW TRANSFORMABLE INTO ANIMAL CHARACTER

FIELD OF THE INVENTION

The invention relates to a pillow transformable into an animal character or toy, particularly for young children.

BACKGROUND OF THE INVENTION

The attractiveness to children of pillows providing animal characters is well recognized, for example, as documented in U.S. Patent Design No. 256,413 and U.S. Pat. No. 4,763,369 which overcome, in different ways, the particular problem of a three dimensional animal body shape interfering with the head cushioning function of the pillow.

However, U.S. Patent Design No. 256,415 teaches that the head of the animal character should be attached to one end of the head cushioning portion of the pillow itself which clearly imposes severe limitations on the animal character effect. U.S. Pat. No. 4,763,369 provides a removable pillowcase printed with the animal body image and means to tighten the pillowcase about the pillow forming depressions defining the head and body profile in, an animal character mode. However, this too can only be a partially effective simulation or representation.

In neither case does the pillow itself undergo a transformation.

SUMMARY OF THE INVENTION

It is an object of the invention to provide a pillow transformable into an animal character or toy, particularly, without a requirement for an additional cover.

According to one aspect of the invention, a pillow transformable into an animal character comprises first and second cushioning layers each having first and second opposite faces, each first face providing a generally flat, head supporting surface and at least one second face having indicia representing an animal character, means for attaching the cushioning layers together one on top of the other with, the second faces in face-to-face engagement concealing the animal character and with the head supporting surfaces outermost, exposed, in the pillow mode and, alternatively, with the first faces concealed in face-to-face engagement and the second faces outermost in the animal character mode transforming the pillow into an animal character.

Preferably, the indicia are three dimensional shapes defining the head and body parts of the animal.

As the three dimensional shapes are concealed and spaced from the head supporting face by cushioning material the three dimensional shapes do not substantially interfere with the smoothness of the head supporting surface enabling a comfortable head supporting function in the pillow mode.

Advantageously, the attachment means attaches the layers together along edges thereof to form a pouch with the first and second faces being, alternatively, on respective outer and inner sides of the pouch, transformation being effected by turning the pouch inside out.

Desirably, each face of each cushioning layer comprises first and second shells, respectively, separated for relative movement during the transformation, the first shells being attached together extending in edge-to-edge coextensive relation and the second shells being attached together at one edge to extend in coextensive relation, and the first and second shells being attached together along other edges.

The formation of the pillow as a reversible pouch is an extremely convenient and effective way of obtaining the transformation either by the adult or the child itself. In addition, the concealed and protected pillow surface will not be soiled by the use of the animal character as a toy.

In a more specific form, the attachment means secures the cushioning layers together along opposite longitudinal and lateral edges, one layer having a slit extending generally medially through its thickness to provide two pouch portions one on each longitudinal side of the slit and having adjacent mouths opening towards each other, transformation being effected by turning each pouch inside out, stuffing the layers through the slit. The pillow may be elongate with the slit extending laterally thereof. Each layer may comprise first and second cover shells connected together for relative lateral movement when turning the pouches inside out to effect transformation to assist in stuffing one layer inside the other.

According to another aspect of the invention, there is provided a pillow transformable into a three dimensional animal character comprising a flexible animal body shell and a flexible pillow shell each having a pouch forming portion with respective pouch mouths joined together, at least one cushioning layer trapped between the shells, the shells being adjustable between optional positions in which the pillow shell is outermost and the animal body shell is turned inside out and stuffed through the mouth of the pillow pouch completely into the pillow pouch forming a pillow, and in which, the pillow shell is turned inside out and stuffed through the mouth of completely into the animal body shell pouch to form an animal character.

Preferably, the animal body shell has a head and upper, fore and lower, hind limbs and the pouch opens to a laterally, medial location between the fore and hind limbs at the front of the animal character.

The provision of the pouch at the front of the animal body provides a more satisfactory interaction between the child and the animal character.

Alternatively, the pouch may open at a medial location at the back of the body providing a hand receiving opening through which a hand can be received behind the head of upper body parts, forming a hand pocket.

According to a further aspect of the invention, there is provided first and second animal character or toy and pillow shells, respectively, each formed as a bag with an open mouth with peripheries of the respective mouths secured together so that the interiors of the bags are in communication with each other, each bag being capable of being turned inside out and stuffed completely through the mouths into the other bag to form, alternatively, one of a pillow and an animal character.

The cushioning means are located between the bags.

BRIEF DESCRIPTION OF THE DRAWINGS

A specific embodiment of a transformable pillow according to the invention will no be described with reference to the accompanying drawings in which.

Figure 6B:
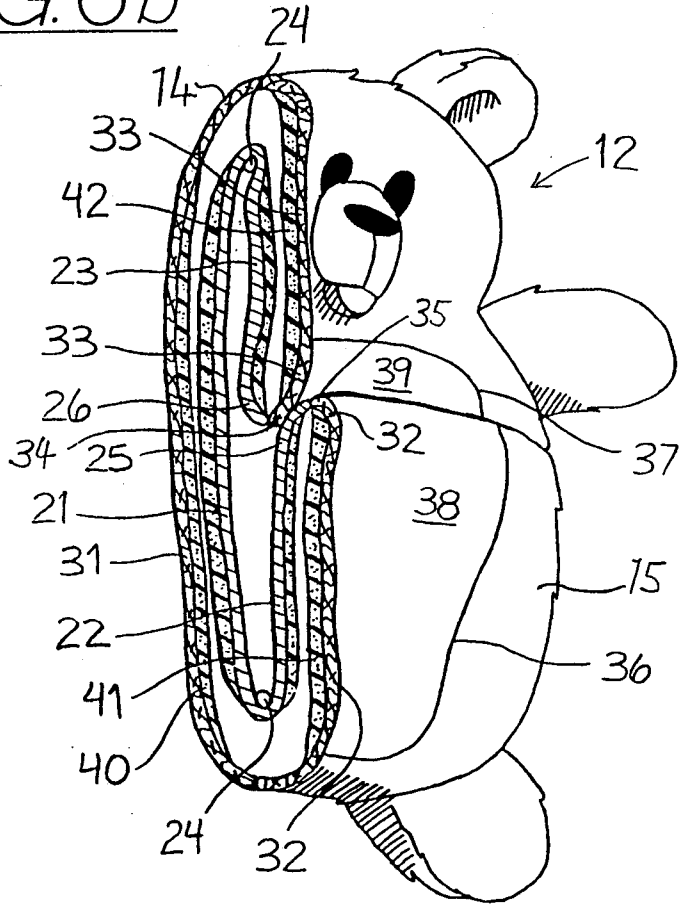
FIGS. 6(*a*) and 6(*b*) are schematic cross sectional views of the invention in the pillow mode and the animal character mode, respectively, with various of the structure layers separated for clarity of illustration.
Figure 6A:
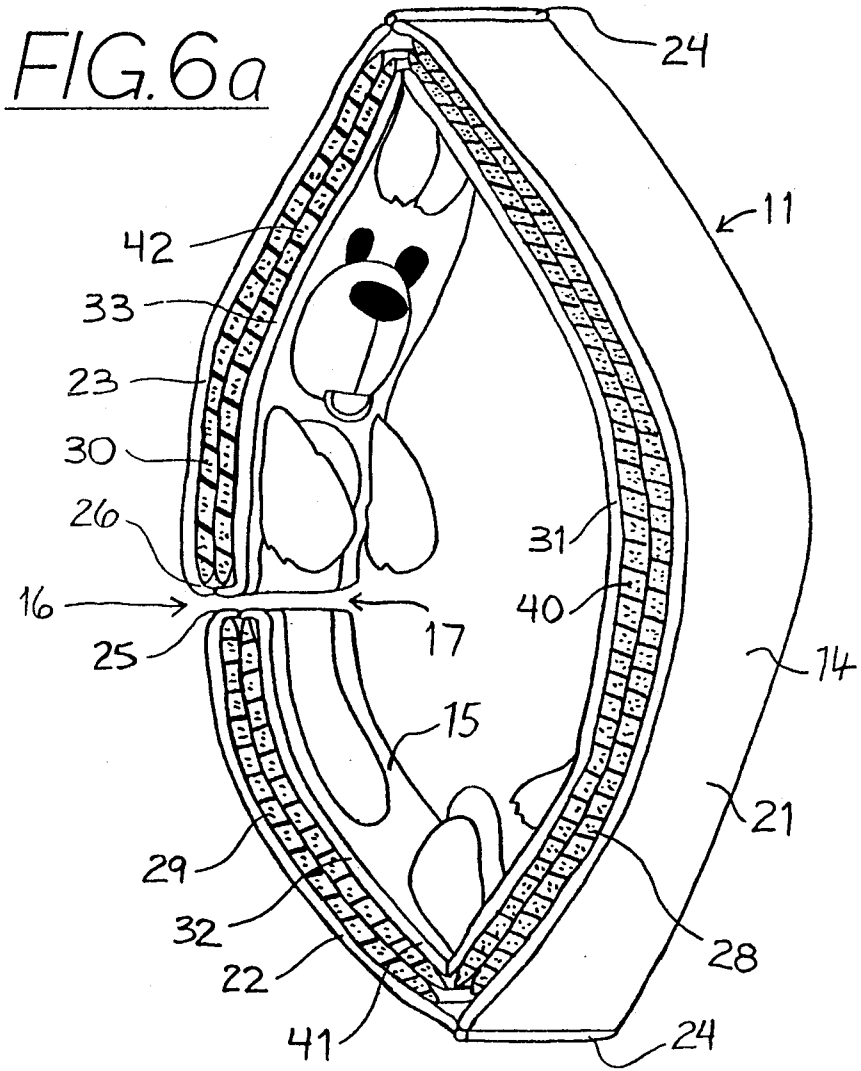
Figure 5:
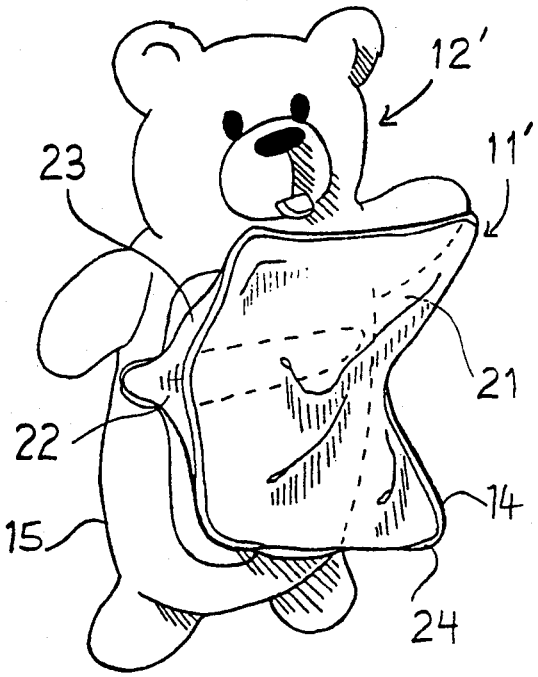
FIG. 5 is a perspective view showing the bag form animal body and pillow shells of the invention.

As shown most clearly in FIGS. 5, 6(*a*) and 6(*b*), the transformable pillow is constructed essentially of a pillow shell 11' and an animal character shell 12' formed as bags 14 and 15, respectively, having mouths 16 and 17, respectively, sewn together bringing the bag interiors into communication.

The pillow shell 12' is made of satin fabric and comprises a rectangular front panel 21 joined along respective edge portions, covered by piping 24, to three adjacent sides of a pair of rectangular rear panels 22 and 23, respectively, having adjacent free edge portions 25 and 26, respectively, defining between them the mouth 16.

As most clearly seen in FIG. 6(*b*), the panel 22 overlaps the panel 23 forming a mouth concealing flap or fly. Discrete layers of resilient foam padding, or fiber, 28, 29 and 30 are secured to underline respective panels 21, 22 and 23, respectively.

The animal character shell 12 simulates a bear-type animal and is made of a suitable fur fabric sewn to form a head with a face mask having individual ears and a body having arms and legs, (fore and hind limbs), and a tail. The mask is three dimensional having features such as a raised snout or nose, tongue etc.

The precise construction of the bear shell will vary considerably according to choice of fabric and facial features, all which is well within the routine skill of the stuffed toy maker, but, in essence, comprises an elongate rear panel forming the back of the bear 31 sewn along all edges to lower and upper front main panels 32 and 33, respectively, having adjacent free edges 35 and 36, 34, respectively forming the bag mouth 17. The panel 32 overlaps panel 33 defining a mouth concealing flap or fly.

The front main panels are also sewn along seams 36 and 37, respectively, to inner panels 38 and 39, respectively, to define a tummy or abdomen of different, lighter color and texture of shorter pile fabric.

The individual limbs and ears are sewn separately to the shell panels while the facial features can be strips of material sewn to overly the fur fabric to be raised therefrom, or in essentially coplanar edge-to-edge relation therewith.

Discrete layers of cushioning 40, 41 and 42 are secured to underly shell panels 31, 32 and 33, respectively.

In effect, the shell and padding layer panels 21, 28, 31, 40 and 22, 29, 41; 23, 30, 33, 42, respectively, together form respective first and second cushioning layers connected to form a structure considered either as a single bag or two pouches with the second cushioning layer split to form the mouth or mouths with the pouches extending from respective opposite sides thereof.

As will be appreciated by those of ordinary skill in making stuffed toys, various gussets may be provided in the panel to accommodate cushioning in either position of transformation.

Figure 1:
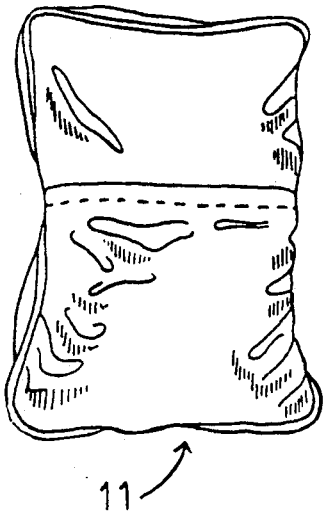
FIG. 1 is a perspective view of the transformable pillow in the pillow mode.
Figure 2:
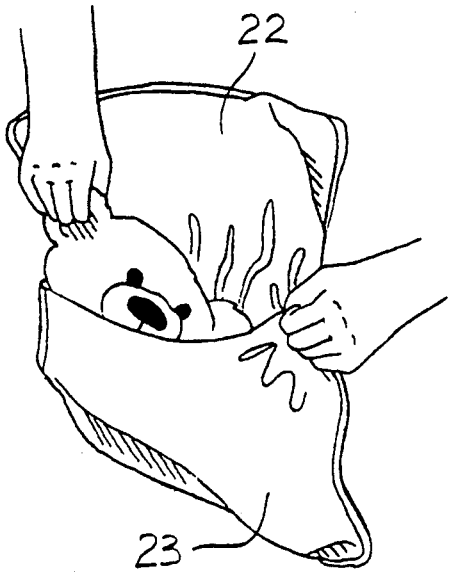
FIG. 2 is a perspective view showing the first stage in the transformation of the pillow to the animal character mode.
Figure 3:
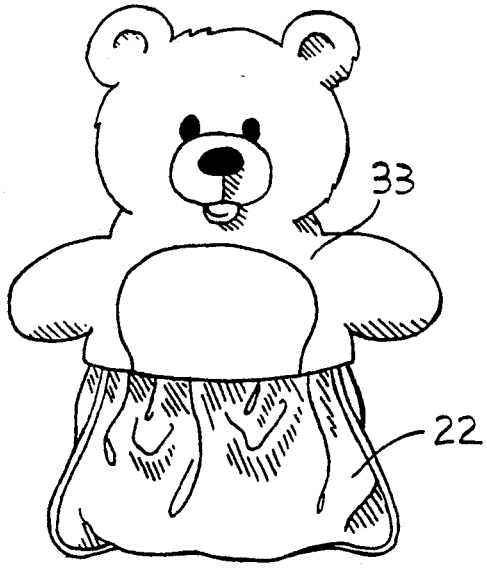
FIG. 3 is a perspective view of the invention halfway through the transformation.
Figure 4:
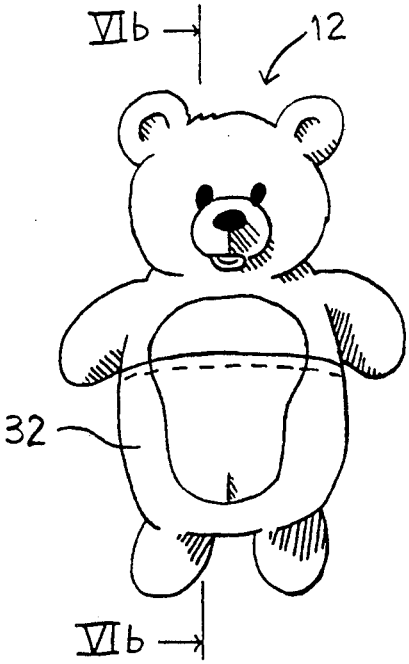
FIG. 4 is a perspective view of the completely formed animal character.

The steps of transformation from a pillow of FIG. 1 to a bear of FIG. 4 is most clearly shown in FIGS. 1–4.

A child inserts a hand into the mouth and progressively pulls out the bear shell, for example, by grasping an ear. This will progressively draw the outer adjacent portion of the pillow shell inside out through the mouth, (aided by a pushing force imposed on such shell portion), eventually turning the upper part of the pillow shell completely inside out, as shown in FIG. 3, in which the upper part of the shell 33 corresponding to the bears upper torso is completely exposed and the corresponding pillow shell portions completely stuffed therein.

The procedure is repeated with the lower par bringing bear shell panel 32 outermost. The pillow shell and cushioning have them been completely turned inside out and stuffed through the mouth into the animal shell in which position the flap or fly completely obscures the slit.

It will be appreciated that, in the reverse procedure, the shells and padding are turned inside out and impelled through the mouths until the bear shell and padding is stuffed completely into the pillow shell, the pillow shell being slightly smaller than the bear shell to ensure a fully stuffed head supporting pillow.

The flap can include a hook and eye type flexible fastener, for example VELCRO (trademark), or other suitable fastening means. In the animal character mode the childs night attire or childs day needs or toys may be stored in the pouch formed by the internal pillow shell.

Otherwise, the pillow shell remains clean in spite of use of the animal character as a toy.

In practice, layers of padding can be thicker than those shown, while the adjacent surfaces of the layers are normally in engagement but shown separated in the drawings for clarity of illustration.

Furthermore, only a single layer of padding or cushioning need be included or, alternatively, could be incorporated in the shell structure or material.

Figure 7:
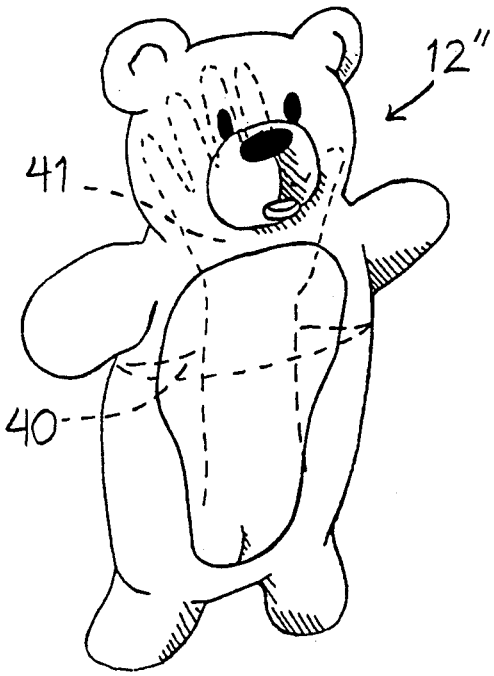
FIG. 7 is a perspective view of an alternative embodiment of the invention, forming a hand puppet, in the animal character mode; and, FIGS. 8(*a*) and 8(*b*) are perspective views of the front and back of a third embodiment of the invention in which the animal character form is a kitten.

As shown in FIG. 7, in an alternative embodiment, a mouth 40 can be formed in the back of the animal character 12", instead of the front, to receive a hand 41 permitting use as a hand puppet with the forearm concealed behind the lower torso of the bear. However, forming the mouth at the front of the animal is normally preferred as providing the most satisfactory interaction of the child with the animal.

Figure 8A:
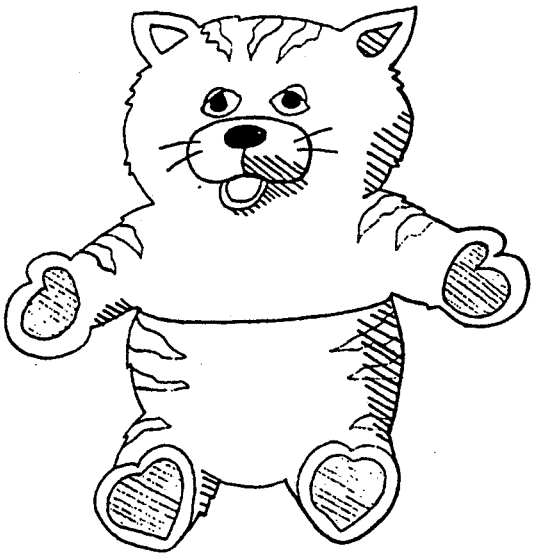
Figure 8B:
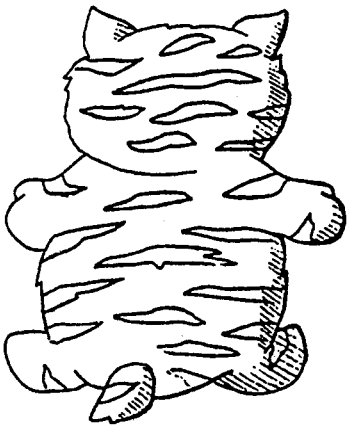

According to an alternative embodiment the animal character shown in FIG. 8 has the form of a kitten with heart shaped pads.

I claim:

1. A pillow transformable into an animal character comprising first and second cushioning layers each having first and second opposite faces, each first face providing a generally flat substantially rectangular, head supporting surface and at least one second face having indicia representing an animal character, means for attaching the cushioning layers together one on top of the other with, the second faces in face-to-face engagement concealing the animal character and with the head supporting surfaces outermost, exposed, in the pillow mode and, alternatively, with the first faces concealed in face-to-face engagement and the second faces outermost in the animal character mode transforming the pillow into an animal character wherein the attachment means secures the cushioning layers together along opposite longitudinal and lateral edges, one layer having a slit extending generally medially through its thickness to provide two pouch portions one on each longitudinal side of the slit and having adjacent mouths opening towards each other, transformation being effected by turning each pouch inside out, and stuffing the layers through the slit.

2. A pillow transformable into an animal character according to claim 1 in which the indicia include three dimensional shapes simulating a head and body parts of an animal.

3. A pillow transformable into an animal character according to claim 1 in which each face of each cushioning layer comprises first and second shells, respectively, separated for relative movement during the transformation, the first shells being attached together extending in edge- to-edge coextensive relation and the second shells being attached together at one edge to extend in coextensive relation, and the first and second shells being attached together along other edges.

4. A pillow transformable into an animal character according to claim 1 in which the pillow is elongate with the slit extending laterally thereof.

5. A pillow transformable into an animal character according to claim 4 in which each layer comprises first and second cover shells connected together for relative lateral movement when turning the pouches inside out to effect transformation to assist in stuffing one layer inside the other.

6. A substantially rectangular head supporting pillow transformable into a three dimensional animal character comprising a flexible animal body shell and a flexible pillow shell, each having a pouch forming portion with respective pouch mouths joined together, cushioning between the shells, the shells being adjustable between optional positions in which the pillow shell is outermost and the animal body shell is turned inside out and stuffed through the mouth of the pillow pouch completely into the pillow pouch forming a pillow, and in which, the pillow shell is turned inside out and stuffed through the mouth of the animal body shell completely into the animal body shell pouch to form a animal character.

7. A pillow transformable into a three dimensional animal character according to claim 6 in which the animal body shell has a head and upper, fore and lower, hind limbs and the pouch opens to a laterally, medial location between the fore and hind limbs at the front of the animal character.

8. A pillow transformable into a three dimensional animal character according to claim 8 in which the animal body shell has a head and upper, fore and lower, hind limbs and the pouch opens to a laterally, medial location between the fore and hind limbs at the rear of the animal character so that a hand can be received in a pouch behind the head portion, providing a hand puppet, with a lower animal character shell part concealing the forearm from a spectator.

9. A substantially rectangular, head supporting pillow transformable into an animal character or toy comprising first and second animal character or toy and pillow shells, respectively, each formed as a bag with an open mouth with peripheries of the respective mouths secured together so that the interiors of the bags are in communication with each other, each bag being capable of being turned inside out and stuffed completely through the mouths into the other bag to form, alternatively, one of a pillow and an animal character and cushioning means located between the bags.

* * * * *